US010920968B2

(12) United States Patent
Mertens et al.

(10) Patent No.: US 10,920,968 B2
(45) Date of Patent: Feb. 16, 2021

(54) LED LIGHTING ASSEMBLY

(71) Applicant: LUMILEDS LLC, San Jose, CA (US)

(72) Inventors: Jürgen Mertens, Wuerselen (DE); Harry Gijsbers, Heerlen (NL)

(73) Assignee: LUMILEDS LLC, San Jose, CA (US)

( * ) Notice: Subject to any disclaimer, the term of this patent is extended or adjusted under 35 U.S.C. 154(b) by 0 days.

(21) Appl. No.: 16/444,427

(22) Filed: Jun. 18, 2019

(65) Prior Publication Data

US 2019/0383472 A1 Dec. 19, 2019

(30) Foreign Application Priority Data

Jun. 19, 2018 (EP) ..... 18178446

(51) Int. Cl.

| | |
|---|---|
| ***F21V 19/00*** | (2006.01) |
| ***F21V 7/04*** | (2006.01) |
| ***F21Y 115/10*** | (2016.01) |
| ***F21S 41/147*** | (2018.01) |
| ***F21S 41/19*** | (2018.01) |
| ***F21S 41/33*** | (2018.01) |

(52) U.S. Cl.

CPC ..... *F21V 19/0035* (2013.01); *F21V 7/048* (2013.01); *F21S 41/147* (2018.01); *F21S 41/192* (2018.01); *F21S 41/337* (2018.01); *F21Y 2115/10* (2016.08)

(58) Field of Classification Search

CPC .. F21V 19/0035; F21V 7/048; F21Y 2115/10; F21S 41/147; F21S 41/192; F21S 41/337

See application file for complete search history.

(56) References Cited

U.S. PATENT DOCUMENTS

| | | | |
|---|---|---|---|
| 9,458,976 | B2 | 10/2016 | Krenn et al. |
| 9,752,744 | B2 | 9/2017 | Muller et al. |
| 10,451,241 | B2 | 10/2019 | Japs et al. |
| 2013/0107564 | A1 | 5/2013 | Yatsuda |

FOREIGN PATENT DOCUMENTS

| | | | | |
|---|---|---|---|---|
| EP | 2915698 | | 9/2015 | |
| EP | 2915698 | A1 * | 9/2015 | ..... F21S 41/147 |
| EP | 3321570 | | 5/2018 | |
| JP | 2013-131313 | | 7/2013 | |
| JP | 2013131313 | A * | 7/2013 | |
| WO | 2005/027598 | | 3/2005 | |
| WO | WO-2005027598 | A1 * | 3/2005 | ..... F21S 43/14 |

* cited by examiner

*Primary Examiner* — Mary Ellen Bowman
(74) *Attorney, Agent, or Firm* — Volpe Koenig

(57) ABSTRACT

The invention describes an LED lighting assembly comprising a reflector unit comprising a number of reflector regions; an LED carrier realized to support at least one LED arrangement; and at least one positioning feature for positioning the LED carrier relative to the reflector unit, wherein a positioning feature is arranged in the same plane as the optical center of the LED arrangement. The invention further describes a method of manufacturing such an LED lighting assembly.

16 Claims, 5 Drawing Sheets

LED LIGHTING ASSEMBLY

FIELD OF INVENTION

The invention describes an LED lighting assembly and a method of manufacturing an LED lighting assembly.

BACKGROUND

Generally, a vehicle headlight must be constructed so that light beam(s) emitted by the headlight comply with any applicable regulations. For example, a low beam should illuminate the area in front of the vehicle satisfactorily while not affecting oncoming traffic. The pattern that must be generated by a front headlight low beam is very precisely defined by the regulations. The pattern or beam shape is largely achieved by a suitably shaped reflector unit. A reflector unit of an automotive lighting unit can have several distinct reflector regions. For example, a reflector unit for a headlamp can have one region dedicated to forming the low beam, and one region dedicated to forming the high beam. In the past, lightbulbs (incandescent, halogen or xenon) could be screwed or inserted into a reflector unit. However, headlamps are now being designed to use light-emitting diodes (LEDs) to generate the front beams. An LED light source can be considerably smaller than a filament or arc of a lightbulb. This means that more effort is required to ensure that an LED is precisely positioned in a reflector, since any slight inaccuracy from the correct position will be greatly amplified in the front beam shape.

In conventional lighting units that use light sources such as incandescent or halogen lamps, the effect of thermal expansion has not been particularly relevant. In the case of an LED lighting unit, even when great care is taken to correctly position the LEDs in the reflector, thermal expansion can result in a noticeable misalignment of the light source relative to the reflector. A once-off precise alignment would be relatively easy to achieve by the manufacturer. However, the possibility of replacing the LED(s) should be given. This means that the precise alignment of the LEDs in the reflector must be ensured, even if the LEDs are replaced by an unskilled person.

Various realizations of LED front lighting units with exchangeable LEDs are known from the prior art. For example, one known headlamp arrangement uses an LED module that can be inserted into a reflector arrangement that is realised in two halves. An upper reflector half is static, while the lower reflector half can be adjusted as necessary by turning an adjustment knob, for example to correct the alignment of the lower reflector part after replacing an LED module. However, replacement of an LED module in such a lighting unit would need to be done by a skilled person. Furthermore, the known systems may exhibit misalignment when the optical centre of a hot LED light source is displaced as a result of thermal expansion. The known systems therefore do not exhibit a satisfactory level of precision.

Therefore, it is an object of the invention to provide an LED lighting assembly that overcomes the problems outlined above.

SUMMARY

The object of the invention is achieved by the LED lighting assembly of claim 1 and by the method of claim 11 of manufacturing an LED lighting assembly.

According to the invention, the LED lighting assembly comprises a reflector unit comprising a number of reflector regions; an LED carrier realised to support at least one LED arrangement; and at least one positioning feature for positioning an LED arrangement relative to a reflector region, which positioning feature is arranged in the same plane as the optical centre of an LED carrier, and wherein a positioning feature comprises a first part formed on the LED carrier and a complementary second part formed on the reflector unit. The reflector unit comprises an aperture through which the LED carrier is inserted into the reflector unit. The aperture is dimensioned to allow a sideways displacement of the LED carrier during insertion of the LED carrier into the reflector unit. Forming the aperture in this way allows a positioning feature to be arranged in a plane that passes through the optical centre of an LED arrangement.

The optical centre of an LED carrier may generally be regarded as a point in the centre of the light-emitting area of the LED arrangement. When the LED arrangement comprises a single LED, the optical centre can simply be the point in the middle of the light-emitting surface of that LED. When the LED arrangement comprises several LEDs, the optical centre may be defined as the point in the middle of the collective light-emitting area. When an LED carrier is designed to support more than one LED arrangement, the optical centre may be defined as the point between the optical centres of the LED arrangements, so that the optical centre may be a virtual point inside the body of the LED carrier. Any point in 3D Cartesian space may be defined relative to three mutually orthogonal X, Y and Z axes that define three mutually orthogonal planes. An optical centre may be regarded as the origin of this 3D space, i.e. at the intersection of the three axes or the three planes. The LED carrier can be pushed into the aperture (in the direction of the Z-axis) and then displaced to one side (along the X-axis) to initially align the first and second parts of at least one positioning feature, and then displaced backwards again in the direction of the Z-axis so that the first and second parts can engage, thereby fixing the position of the LED carrier in the reflector unit.

An advantage of the inventive LED lighting assembly is that complete and precise alignment of an LED arrangement relative to a reflector region can be achieved by the positioning feature(s). A positioning feature may be regarded as any suitable physical element shaped or formed to achieve a precise engagement of the LED carrier with the reflector unit. By arranging a positioning feature in the same plane as the optical centre, any thermal expansion of the LED carrier will be effected symmetrically about that positioning feature, so that the optical centre of the LED carrier will not be displaced relative to the reflector unit. As a result, the accuracy of shaping of the light beam can be maintained throughout the lifetime of the lighting unit. Once the LED carrier has been arranged in the reflector unit, no further correction or alignment step is necessary. The makes it simple for any person—not necessarily trained personnel—to replace an existing LED carrier by a new LED carrier.

According to the invention, the method of manufacturing an LED lighting assembly comprises the steps of providing an LED carrier supporting a number of LED arrangements; providing a reflector unit comprising a number of reflector regions and an aperture dimensioned to allow a sideways displacement of the LED carrier during insertion of the LED carrier into the reflector unit; forming, in the same plane as the optical centre of an LED arrangement, at least one positioning feature for positioning the LED carrier relative to the reflector unit, wherein a positioning feature is arranged in the same plane as the optical centre of the LED arrangement, wherein a positioning feature comprises a first part formed on the LED carrier and a complementary second part formed on the reflector unit; and arranging the LED carrier in the reflector unit, with a sideways displacement of the LED carrier during insertion of the LED carrier into the reflector unit to initially align the first and second parts of at least one positioning feature.

When the LED carrier is arranged in the reflector unit, a positioning feature advantageously acts to automatically position an LED arrangement correctly relative to a reflector region of the reflector unit. In this way, simply by inserting the LED carrier into the reflector unit, a very precise alignment of an LED arrangement is automatically achieved in the corresponding spatial directions. An advantage of the inventive method is the ease with which an LED arrangement is correctly positioned relative to a reflector region. A further advantage of the inventive method is that it can be relatively straightforward to design the LED carrier and the reflector unit to include the positioning features, so that manufacturing costs may be kept favourably low.

The dependent claims and the following description disclose particularly advantageous embodiments and features of the invention. Features of the embodiments may be combined as appropriate. Features described in the context of one claim category can apply equally to another claim category.

In the context of the invention, the reflector unit is to be understood to comprise an essentially one-piece component, i.e. the reflector unit can be manufactured and handled as a single unit. In contrast to the prior art assemblies, there is no need to physically connect two or more reflector parts and to take the necessary measures to ensure their precise alignment, for example. The inventive LED lighting assembly may be realised in any suitable manner. For example, the inventive LED lighting assembly may be designed so that the LED carrier is inserted into the reflector unit from the front. However, most automotive lighting units are only accessible from the rear. Therefore, without restricting the invention in any way, it may be assumed in the following that the LED lighting assembly is designed so that the LED carrier is inserted into the reflector unit from the rear.

Without restricting the invention in any way, the LED carrier may be assumed to comprise a power supply interface for connecting one or more LEDs to a power supply and may be referred to in the following as an "adapter" or an "LED module". For example, after inserting the LED carrier into the reflector unit, a power supply may be connected to the LED carrier using a suitable connector.

As mentioned above, an LED front lighting unit may be realised as a single unit for generating a high beam as well as a low beam. In the following, it may be assumed that the LED carrier comprises a first seat to receive a low-beam LED arrangement and a second seat to receive a high-beam LED arrangement. Preferably, the first seat is provided to position a low-beam LED arrangement so that it emits into one reflector region, and the second seat is provided to position a high-beam LED arrangement so that it emits into the other reflector region. The first and second seats may be inclined so that the LEDs in each case emit towards the rear of the reflector. The reflector may be assumed to be shaped in such a way as to reflect the light back out with a desired beam shape. When used in an automotive lighting unit, the reflector may be assumed to shape the outgoing light beam (s) in compliance with any applicable regulation.

The orientation of the LED carrier in the reflector unit of the LED lighting assembly is defined in the following in the context of a three-dimensional space in which the Z-axis is parallel to the longitudinal axis of the reflector unit, the X-axis lies in the same horizontal plane as the Z-axis, and the Y-axis is vertical. The intersection of these three mutually orthogonal axes may be understood to coincide with the optical centre of the LED carrier. The Z-axis preferably coincides with the horizontal longitudinal axis of the reflector unit. The longitudinal axis of the reflector unit may be understood to extend outward from the reflector unit. The terms "horizontal" and "vertical" are to be understood to have their generally accepted meaning.

A positioning feature can be realised in any appropriate manner. Preferably, the first and second parts of a positioning feature are realised to engage with each other and/or to be pressed against each other as will be explained below.

In Cartesian space, as indicated above, three intersecting planes define the X, Y and Z axes. To completely fix the position of the LED carrier in the reflector unit, the inventive LED lighting assembly preferably comprises an X-axis positioning feature and/or a Y-axis positioning feature and/or a Z-axis positioning feature. Each positioning feature is realised to position the LED arrangement relative to a reflector region along the corresponding axis of the three-dimensional space. IN a particularly preferred embodiment of the invention, the LED lighting assembly comprises all three positioning features, i.e. an X-axis positioning feature, a Y-axis positioning feature and a Z-axis positioning feature.

The inventive LED lighting assembly preferably also comprises a further positioning feature for fixing the position of the LED carrier relative to an axis of rotation. This further positioning feature does not need to be arranged in a plane that contains the optical centre of the LED carrier.

Preferably, the first part of a positioning feature is realised as a protrusion formed on the LED carrier. In other words, the first part of a positioning feature protrudes outward from the body of the LED carrier. For example, the first part of a positioning feature can be shaped as a small cylindrical protrusion and can be moulded as an integral part of the LED carrier. Preferably, the complementary second part of that positioning feature comprises a suitably shaped surface of the reflector unit. For example, a first part of a positioning feature formed on the LED carrier can, when the LED carrier is inserted into the reflector unit, be pressed into a recess formed in the body of the reflector unit.

In a particularly preferred embodiment, the first parts of the X-axis and Z-axis positioning features are realised by a pair of protrusions arranged on opposite faces of the LED carrier. For example, an upper protrusion is formed to point upward and outward from the LED carrier body, and a lower protrusion is formed to point downward and outward from the LED carrier body. These X-axis and Z-axis positioning features are arranged to lie along the Y-axis, which passes through the LED carrier's optical centre. In this preferred embodiment, the second parts of the X-axis and Z-axis positioning features are jointly realised by a pair of correspondingly placed notches or V-shaped grooves formed on the reflector unit to receive the protrusions. These can be visualised as one V-shaped groove formed to receive the upper protrusion, and an identical V-shaped groove formed to receive the lower protrusion. The V-shaped groove may be visualized as a "V" whose lower point lies behind the Y-axis and which opens outward towards the front of the reflector. These X-axis and Z-axis positioning features are arranged in a vertical symmetry plane of the LED lighting assembly. The position of the LED carrier is fixed in the X-axis by centring the V-shaped groove about the Y-axis. The position of the LED carrier is fixed in the Z-axis by appropriate dimensions for the V-shaped grooves, for example by arranging the apex of the "V" at a suitable distance behind the Y-axis. These aspects will be made clearer in the drawings.

As mentioned above, the second part of a positioning feature can comprise a planar surface of the reflector unit. Preferably, alignment of the LED carrier in the vertical Y-axis is achieved by a positioning feature whose first part is a protrusion formed on the LED carrier, and whose second part is a flat surface of the aperture of the reflector unit. When these parts meet during insertion of the LED carrier, the position of the LED carrier is fixed in the Y-axis.

The reflector unit and LED carrier may be designed so that when the LED carrier is inserted through the aperture in the reflector unit, the LED carrier is secured to the reflector unit. However, in a preferred embodiment of the invention, the LED lighting assembly comprises an assembly interface arranged to secure the LED carrier relative to the reflector unit. The assembly interface can be realised as a type of frame extending about the reflector unit and LED carrier. The assembly interface preferably comprises means by which the LED carrier is secured relative to the reflector unit.

In a preferred embodiment of the invention, the assembly interface further comprises a number of spring-loaded elements arranged to press the LED carrier against the reflector unit, for example a spring-loaded element arranged to press the LED carrier against the reflector unit in the direction of the X-axis and/or a spring-loaded element arranged to press the LED carrier against the reflector unit in the direction of the Y-axis, and/or a spring-loaded element arranged to press the LED carrier against the reflector unit in the direction of the Z-axis. Since this type of assembly interface comprises functional elements that assist in assembly of the LED carrier and reflector unit, the assembly interface may also be referred to as an assembly frame, and these terms may be used interchangeably in the following. A spring-loaded element can be realised in any suitable manner. For example, a spring-loaded element may be realised as a coiled spring mounted to the body of the assembly frame to point in the direction of an axis of the three-dimensional space. In a preferred embodiment of the invention, a spring-loaded element is realised as a cantilever spring, and may be formed from the body of the assembly frame. Preferably, the assembly frame comprises several such spring-loaded elements, for example three cantilever springs arranged to press the LED carrier against the reflector unit.

In a preferred embodiment of the invention, the LED lighting assembly further comprises a locking arrangement realised to lock the LED carrier in the assembly frame. For example, the locking arrangement may comprise a number of hooks that engage with a number of suitably shaped counterparts in the LED carrier and/or the assembly frame.

The positioning features are not only advantageous in aligning the LED carrier correctly to the reflector unit, but can also assist during earlier stages in the manufacturing process. Usually, a reflector unit is made of injection-moulded plastic. In a preferred embodiment of the invention, the step of providing the reflector unit comprises moulding the reflector unit using a mould that is shaped to simultaneously form the reflector unit as well as a complementary second part of a positioning feature. For example, the V-shaped grooves described above as part of the X-axis and Z-axis positioning features can be formed as an integral part of the reflector unit using a simple mould shape, i.e. without adding to the overall cost of the moulding procedure. Another advantage of this approach is that these elements of the X-axis and Z-axis positioning features can be formed without in any way compromising the moulding procedure. The quality of the moulded reflector unit is therefore not reduced.

Another advantage of the inventive LED assembly is that the positioning features can also assist during mounting LEDs on the LED carrier. For example, an automated tool may use a positioning feature first part as a reference when placing LEDs on the LED carrier. The automated tool can be configured to know the exact geometry of the LED carrier with its positioning feature first parts, so that an LED can be positioned with a very high degree of precision onto the LED carrier when the tool uses the positioning feature first parts as a reference.

Other objects and features of the present invention will become apparent from the following detailed descriptions considered in conjunction with the accompanying drawings. It is to be understood, however, that the drawings are designed solely for the purposes of illustration and not as a definition of the limits of the invention.

BRIEF DESCRIPTION OF THE DRAWINGS

In the drawings, like numbers refer to like objects throughout. Objects in the diagrams are not necessarily drawn to scale.

DETAILED DESCRIPTION OF THE PREFERRED EMBODIMENT

Figure 1:
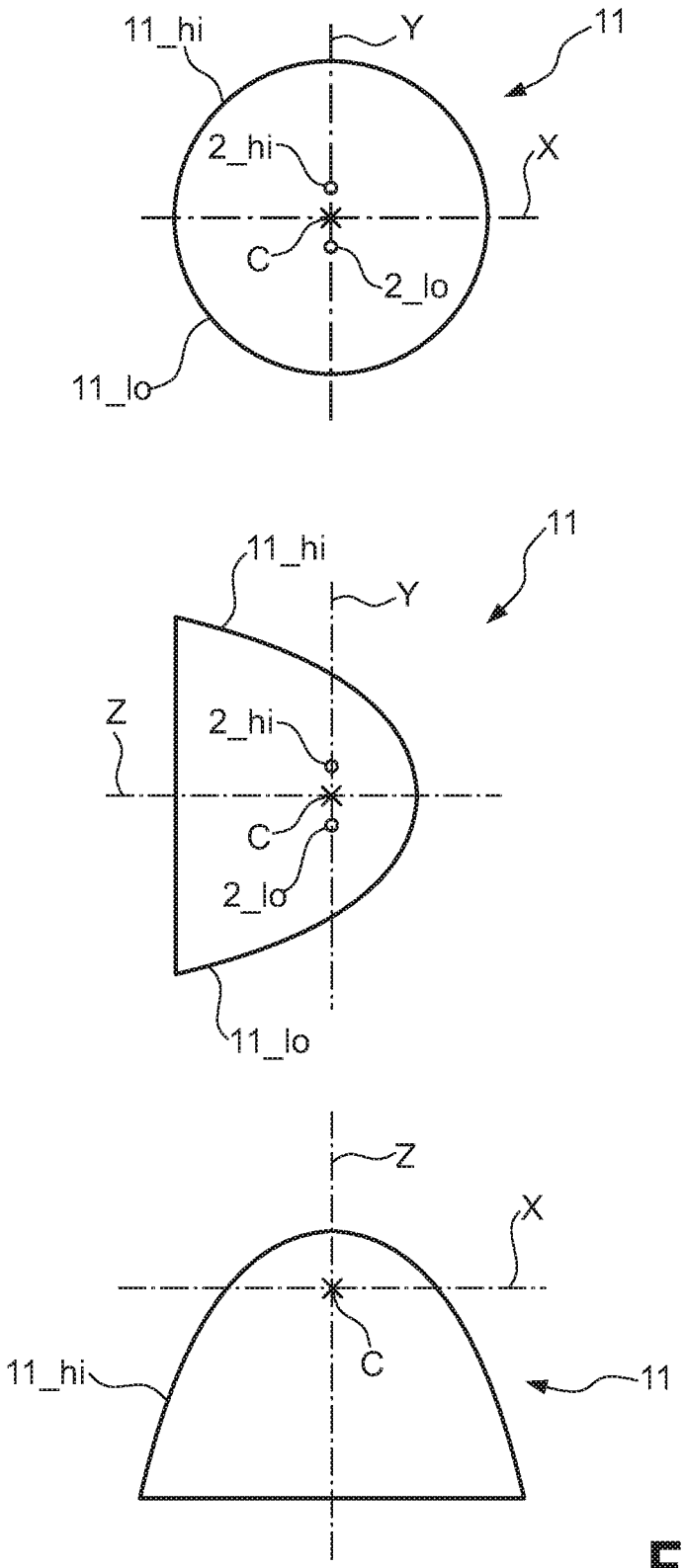
FIG. 1 indicates a reflector unit and LED arrangements in relation to three axes of a coordinate system.

FIG. 1 shows three views of a reflector unit 11 of an embodiment of the inventive LED lighting assembly, in a three-dimensional space defined by three axes. The diagram shows a front view into the reflector (top part of diagram), a side view (middle part of the diagram) and a plan view from above (lower part of diagram). The reflector unit 11 comprises an upper portion 11_hi and a lower portion 11_lo. When an LED carrier is arranged in this reflector unit 11, an upper LED arrangement will emit light into the upper portion 11_hi and a lower LED arrangement will emit light into the lower portion 11_lo. Each LED arrangement is represented by a point corresponding to its optical centre. The LED carrier optical centre C 10 is midway between the optical centres of the LED arrangements 2_hi, 2_lo. The diagram shows the X-axis and Y-axis passing through the optical centres of the LED arrangements 2_hi, 2_lo and the Z-axis passing through the intersection of the X-axis and Y-axis. The Z-axis is also the longitudinal axis of the reflector unit 11.

Figure 2:
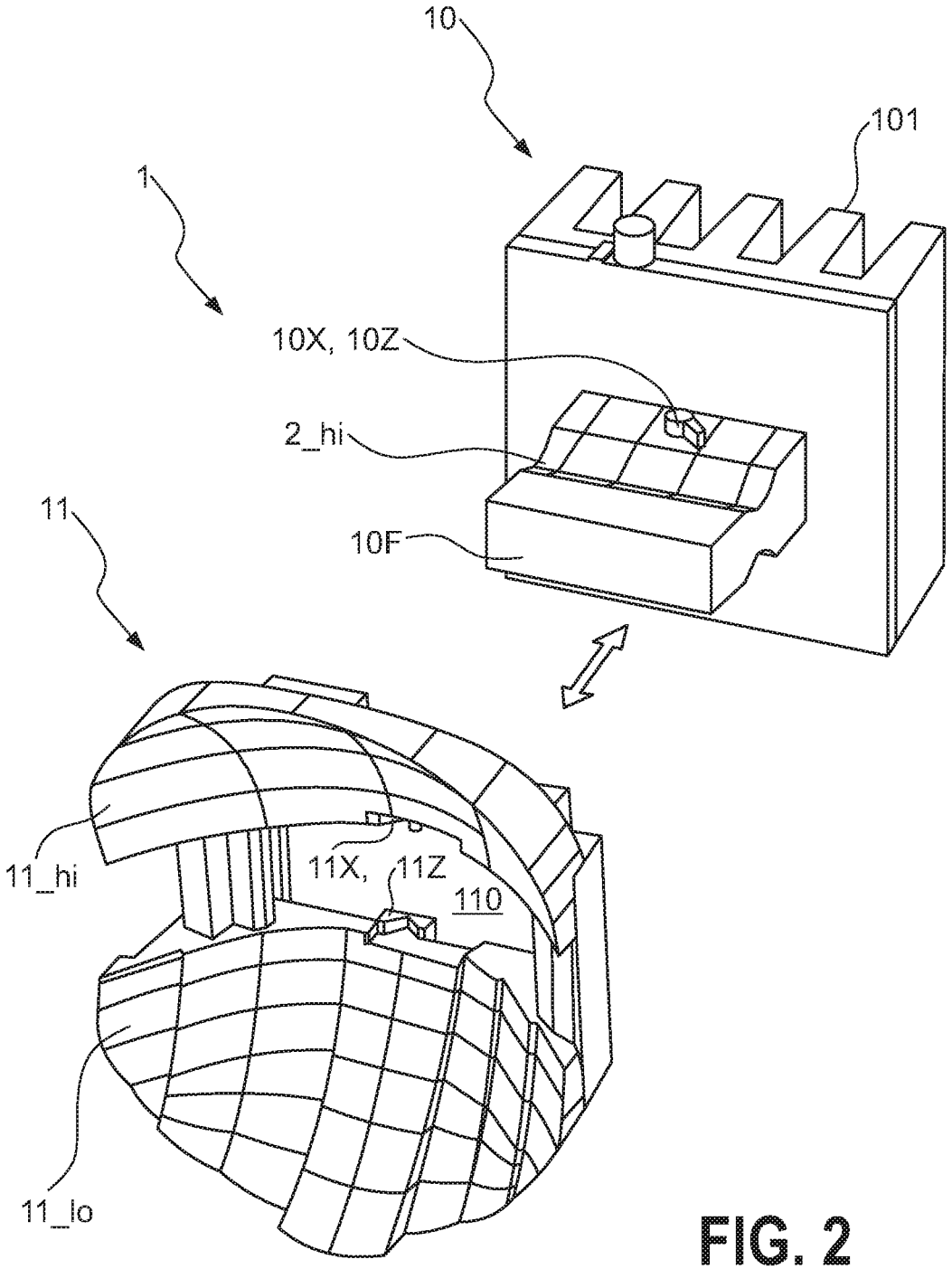
FIG. 2 shows a perspective view of an embodiment of the inventive LED lighting assembly.

FIG. 2 shows a perspective view of parts of an embodiment of the inventive LED lighting assembly 1. The diagram shows a reflector unit 11 with functionally separate reflector regions 11_lo, 11_hi as used—for example—in automotive headlights. In this exemplary embodiment, a lower reflector region 11_lo is used to generate a low beam, and an upper reflector region 11_hi is used to generate a high beam. The reflector unit 11 is formed in one piece to include reflector regions 11_hi, 11_lo and an aperture 110. The diagram also shows an LED carrier 10 that comprises a front part 10F (to which LED arrangements are mounted) extending from a block-shaped part that includes a heatsink 101 and which also incorporates electronic circuitry and a power connector. The front part 10F of the LED carrier 10 will be inserted through the aperture 110 in the reflector unit 11 so that the LEDs are arranged at predefined positions within the reflector unit 11. The LED carrier 10 can be inserted into the reflector unit 11 and removed from the reflector unit 11 in the direction indicated by the arrow.

In this exemplary embodiment, the LED carrier has inclined mounting surfaces or "seats" for receiving LEDs, and each mounting surface is inclined to face into the corresponding reflector region. An LED arrangement 2_hi is shown on the upper side of the LED carrier 10 (a corresponding LED arrangement on the lower side cannot be seen but may be assumed to be present). The position of the LED carrier 10 relative to the reflector unit 11 will be fixed by positioning features. The LED carrier 10 is formed to have protrusions 10X, 10Z or positioning feature first parts 10X, 10Z on opposite sides of the front part 10F (only one set can be seen here, on the top of the front part 10F). The reflector unit 11 is formed to have complementary second parts 11X, 11Z. In this embodiment, the position of the LED carrier 10 along both the X-axis and Z-axis will be fixed when the first parts 10X, 10Z engage with the second parts 11X, 11Z.

Figure 3A:
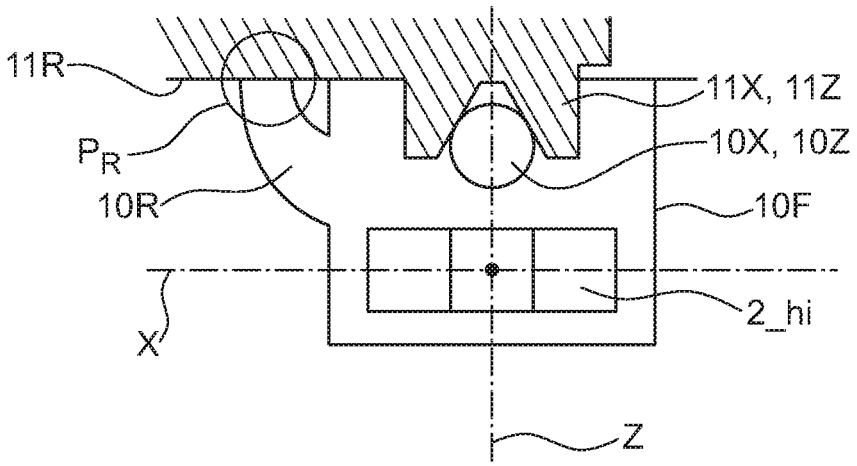
FIGS. 3A and 3B show partial cross-sections through an embodiment of the LED lighting assembly.
Figure 3B:
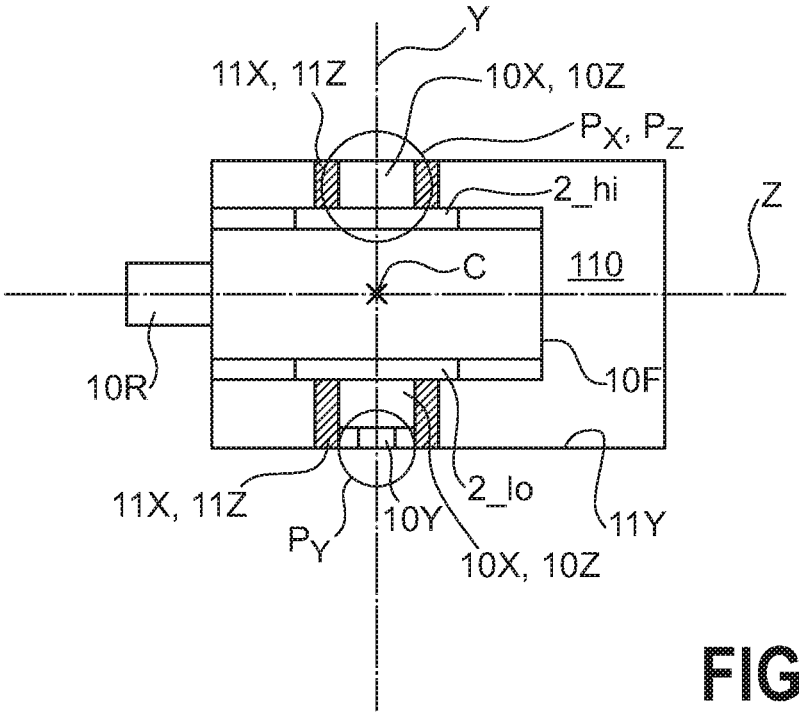

This can be seen more clearly in FIG. 3A and FIG. 3B, which show an LED arrangement 2_hi after the LED carrier 10 has been inserted into the reflector unit 11. Here, the LED arrangement 2_hi comprises three series-connected LEDs. In FIG. 3A, the optical centre of the LED arrangement is indicated by the small circle in the centre of the middle LED. A similar arrangement of LEDs is mounted in a seat 10_lo on the underside of the LED carrier 10 front part, as shown in FIG. 3B, which also shows the LED carrier optical centre C. Once the positioning feature $P_X$, $P_Z$ is completed by engaging the first parts 10Z, 10Z and the second parts 11X, 11Z, the LED carrier 10 is prevented from moving in the Z-direction and in the X-direction. In this exemplary embodiment, the X-axis and Z-axis positioning features $P_X$, $P_Z$ are realised jointly, but it will be understood that these could easily be realised separately. The diagrams also show a further positioning feature $P_R$ that acts to prevent a rotation movement of the LED carrier 10 with respect to the reflector unit 11. This is achieved by a projection 10R formed on the body of the LED carrier 10 and shaped to engage with or lie against a surface of the reflector unit 11.

Figure 4:
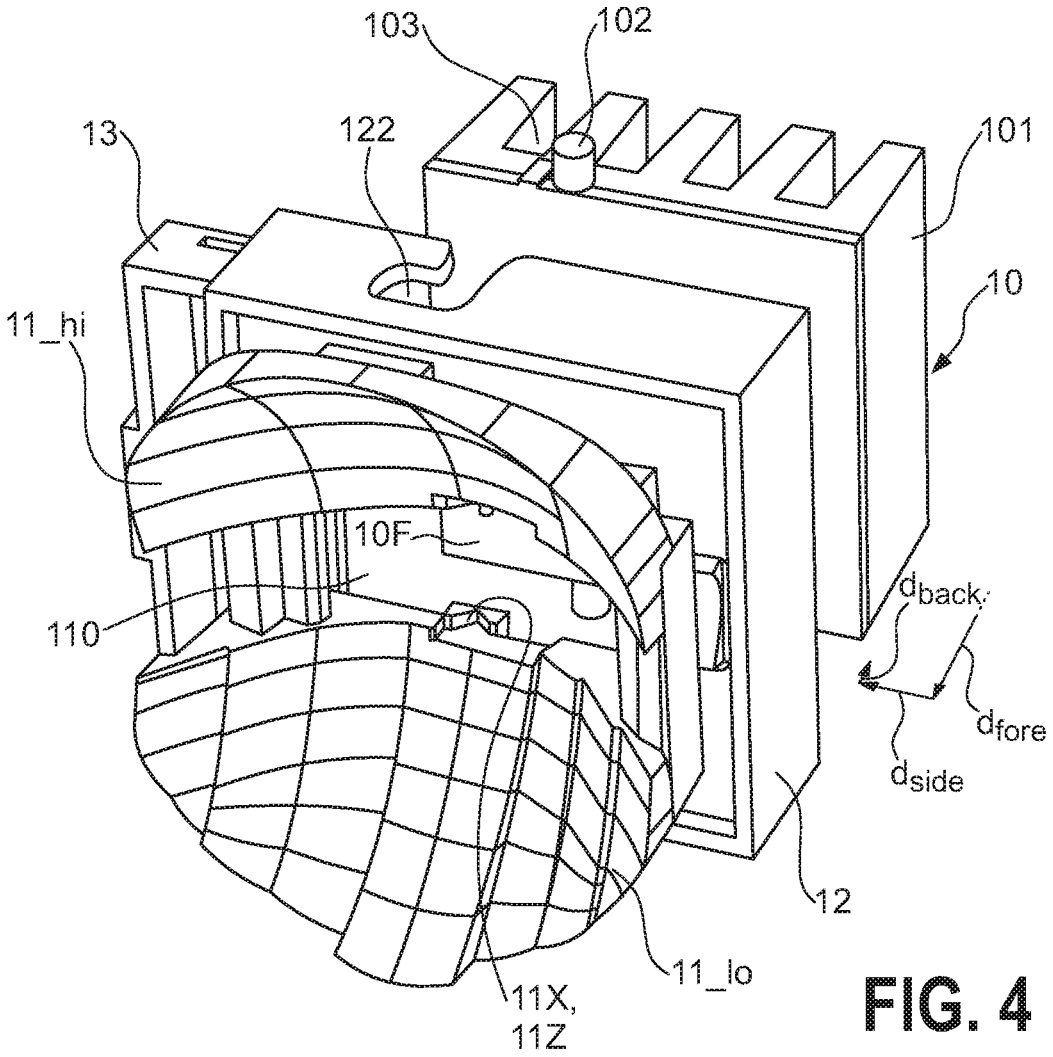
FIG. 4 shows a perspective view of another embodiment of the LED lighting assembly.

FIG. 4 shows a perspective view of another embodiment of the inventive LED lighting assembly 1. An assembly frame 12 is used in this exemplary embodiment to assist in holding the LED carrier 10 in place relative to the reflector unit 11. The assembly frame 12 may be realised in one piece with the reflector, for example, or may be realised as a separate component. The elements 10, 11, 12 are shown prior to insertion of the LED carrier 10 into the reflector unit 11. The diagram also shows the sequence of movements during insertion, namely a forward movement $d_{fore}$ to insert the LED carrier through the aperture 110, a sideways or lateral displacement $d_{side}$ to bring the first parts 10X, 10Z into place relative to the second parts 11X, 11Z, and then a backwards displacement $d_{back}$ to engage the first and second parts of the positioning features $P_X$, $P_Z$.

Figure 5:
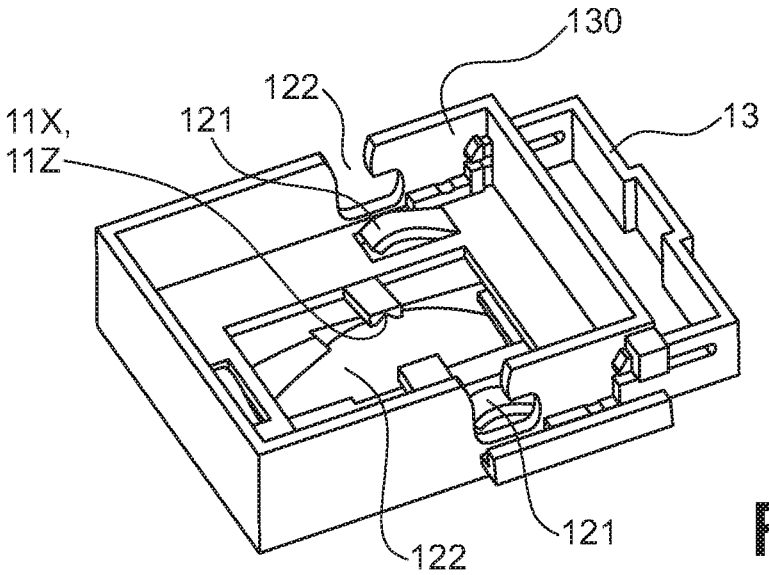
FIG. 5 shows an assembly frame for an embodiment of the inventive LED lighting assembly.

Here, the LED carrier 10 comprises a pin 102 at the top and bottom of the heatsink portion 101, and these pins 102 will fit into slots 122 of the assembly frame 12. A locking element 13 is also shown. This can be pushed into place once the LED carrier 10 has been correctly inserted into the reflector unit 11, and—by means of recesses 103 on the LED carrier 10—will serve to lock the LED carrier 10 to the assembly frame 12. This can be seen more clearly in FIG. 5, which shows a view from behind (without the LED carrier for the sake of clarity). The diagram shows the locking element 13 with a pair of hooks 130 that can engage with the correspondingly shaped recesses 103 on the LED carrier 10. To remove the LED carrier 10, a user can manually deflect the hooks 130 to release the LED carrier 10 from the assembly.

Figure 6:
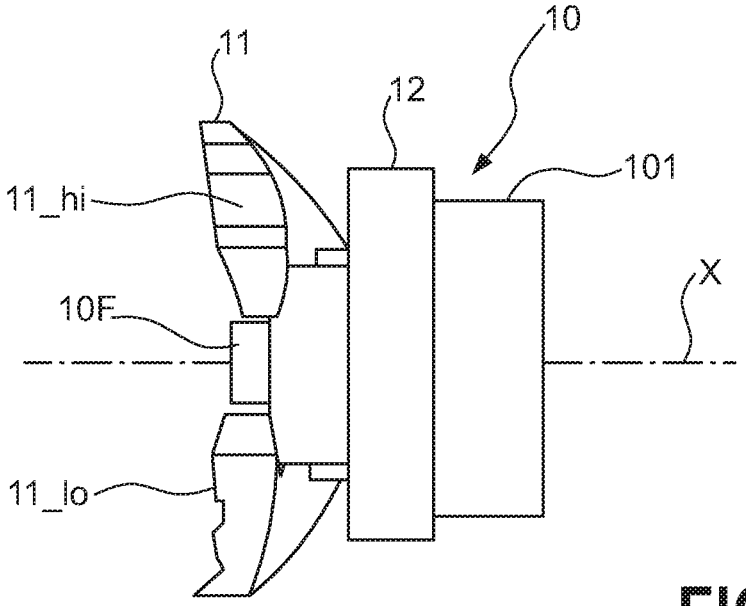
FIG. 6 shows a side view of the LED lighting assembly of FIG. 4.

FIG. 6 shows a side view of the LED lighting assembly 1 after insertion of the LED carrier 10 into the reflector unit 11.

Figure 7:
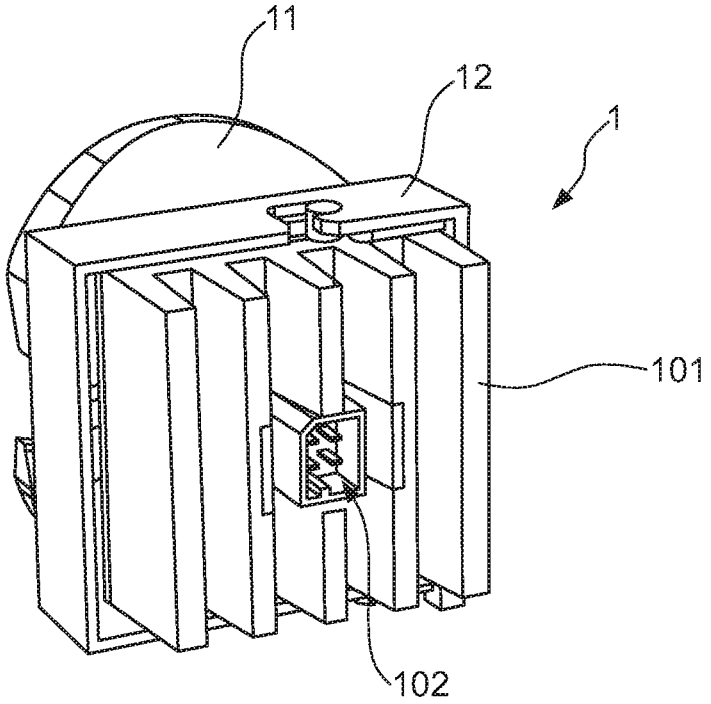
FIG. 7 shows a rear view of an embodiment of the inventive LED lighting assembly.

FIG. 7 shows a rear view of an embodiment of the inventive LED lighting assembly 1 in its completely assembled state. The LED carrier 10 comprises any circuitry necessary to connect the LED arrangement(s) with a power interface 102. This can be connected to a power supply in the usual manner using a suitable cable.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

REFERENCE SIGNS

LED lighting assembly 1
LED carrier 10
front part 10F
seat 10_lo, 10_hi
heatsink 101
positioning feature first part 10X, 10Y, 10Z, 10R
power supply interface 102
reflector unit 11
reflector region 11_hi, 11_lo
positioning feature second part 11X, 11Y, 11Z, 11R
reflector unit aperture 110
vertical bar 111
assembly frame 12
assembly frame aperture 120
cantilever spring 121
lock 13
low-beam LED arrangement 2_lo
high-beam LED arrangement 2_hi
axes X, Y, Z
positioning feature $P_X$, $P_Y$, $P_Z$, $P_R$
optical centre C
foreword movement $d_{fore}$
lateral displacement $d_{side}$
backward displacement $d_{back}$

What is claimed is:

1. An LED lighting assembly comprising:

a reflector unit comprising a plurality of reflector regions and an aperture;

an LED carrier at least partially disposed in the aperture in the reflector unit;

at least one LED arrangement on the LED carrier, the at least one LED arrangement having an optical center; and a first positioning part on the LED carrier and a second positioning part on the reflector unit, the first positioning part and the second positioning part being complimentary to position the LED carrier relative to the reflector unit, the first positioning part and the second positioning part being in the same plane as the optical center of the LED arrangement.

2. The LED lighting assembly according to claim 1, wherein the first positioning part and the second positioning part comprise at least one of an X-axis positioning part configured to position the at least one LED arrangement relative to one of the plurality of reflector regions along an X-axis of a three-dimensional space, a Y-axis positioning part configured to position the at least one LED arrangement relative to one of the plurality of reflector regions along a Y-axis (Y) of the three-dimensional space or a Z-axis positioning part configured to position the at least one LED arrangement relative to one of the plurality of reflector regions (ll lo, ll hi) along a Z-axis of the three-dimensional space.

3. The LED lighting assembly according to claim 1, wherein the reflector unit is essentially a one-piece component, and the aperture in which the LED carrier is at least partially disposed is in a rear portion of the reflector unit.

4. The LED lighting assembly according to claim 1, further comprising a further positioning part configured to position the at least one LED arrangement relative to an axis of rotation of the LED carrier.

5. The LED lighting assembly according to claim 1, wherein the first positioning part comprises a protrusion formed on the LED carrier.

6. The LED lighting assembly according to claim 5, wherein the second positioning part comprises a planar surface of the reflector unit.

7. The LED lighting assembly according to claim 1, wherein the first positioning part and the second positioning part are an X-axis positioning part and a Z-axis positioning part, the X-axis positioning part and the Z-axis positioning part being a pair of protrusions on opposite faces of the LED carrier and complementary notches formed in the reflector unit.

8. The LED lighting assembly according to claim 7, wherein the X-axis and Z-axis positioning features lie along the Y-axis, which passes through the optical center of the at least one LED arrangement.

9. The LED lighting assembly according to claim 1, further comprising an assembly interface that secures the LED carrier relative to the reflector unit.

10. The LED lighting assembly according to claim 9, wherein the assembly interface comprises a plurality of spring-loaded elements configured to press the LED carrier against the reflector unit.

11. A method of manufacturing an LED lighting assembly, comprising:

providing an LED carrier comprising a plurality of LED arrangements;

providing a reflector unit comprising a plurality of reflector regions and an aperture;

forming, in the same plane as an optical centre of the plurality of LED arrangements, a first positioning part on the LED carrier and a second positioning part on the reflector unit such that the first positioning part and the second positioning part are complimentary to position the LED carrier relative to the reflector unit; and arranging the LED carrier inn the aperture in the reflector unit with a sideways displacement of the LED carrier initially aligning the first and second positioning parts.

12. The method according to claim 11, further comprising moulding the reflector unit using a mould shaped to simultaneously form the reflector unit and the second positioning part.

13. The method according to claim 11, further comprising controlling a placement tool to use one of the first and second positioning parts as a reference during placing the LED arrangement on the LED carrier.

14. The method according to claim 11, wherein the step of arranging the LED carrier in the reflector unit comprises inserting the LED carrier into the reflector unit through an aperture formed in the reflector unit.

15. The method according to claim 11, further comprising providing a spring-loaded assembly interface to secure the LED carrier to the reflector unit.

16. The LED lighting assembly of claim 1, further comprising a third positioning part, the first positioning part comprising an X-axis positioning part configured to position the at least one LED arrangement relative to one of the plurality of reflector regions along an X-axis of a three-dimensional space, the second positioning part comprising a Y-axis positioning part configured to position the at least one LED arrangement relative to one of the plurality of reflector regions along a Y-axis (Y) of the three-dimensional space, and the third positioning part comprising a Z-axis positioning part configured to position the at least one LED arrangement relative to one of the plurality of reflector regions along a Z-axis of the three-dimensional space.

* * * * *